US008833703B2

(12) United States Patent
Steffen, II et al.

(10) Patent No.: US 8,833,703 B2
(45) Date of Patent: Sep. 16, 2014

(54) SYSTEMS AND METHOD FOR A CROSSING EQUIPMENT CONTROLLER

(75) Inventors: Michael W. Steffen, II, Melbourne, FL (US); Steven Murphy, Melbourne, FL (US); Brian Wesley Isaacson, Melbourne, FL (US); William D. Shields, Grain Valley, MI (US); James B. Strecker, Grain Valley, MI (US)

(73) Assignee: General Electric Company, Schenectady, NY (US)

( * ) Notice: Subject to any disclaimer, the term of this patent is extended or adjusted under 35 U.S.C. 154(b) by 148 days.

(21) Appl. No.: 13/448,430

(22) Filed: Apr. 17, 2012

(65) Prior Publication Data

US 2013/0015297 A1 Jan. 17, 2013

Related U.S. Application Data

(60) Provisional application No. 61/508,212, filed on Jul. 15, 2011.

(51) Int. Cl.
*B61L 29/32* (2006.01)

(52) U.S. Cl.
CPC *B61L 39/22* (2013.01); *B61L 29/32* (2013.01)
USPC ..... 246/125

(58) Field of Classification Search
CPC ..... B61L 29/28; B61L 29/30; B61L 29/32
USPC ..... 246/122 R, 125, 293, 473.1
See application file for complete search history.

(56) References Cited

U.S. PATENT DOCUMENTS

| | | | | |
|---|---|---|---|---|
| 7,254,467 | B2 | 8/2007 | Fries et al. | |
| 7,575,202 | B2 * | 8/2009 | Sharkey et al. | 246/293 |
| 7,832,691 | B2 * | 11/2010 | Reibeling et al. | 246/125 |
| 8,500,071 | B2 * | 8/2013 | O'Dell | 246/293 |
| 2002/0096605 | A1 | 7/2002 | Berry et al. | |
| 2004/0181321 | A1 | 9/2004 | Fries et al. | |
| 2007/0040070 | A1 * | 2/2007 | Stevenson et al. | 246/122 R |
| 2007/0084974 | A1 * | 4/2007 | Sharkey et al. | 246/473.1 |
| 2011/0095139 | A1 * | 4/2011 | O'Dell | 246/293 |
| 2012/0248261 | A1 * | 10/2012 | Nichter | 246/125 |
| 2013/0270395 | A1 * | 10/2013 | Steffen et al. | 246/125 |

FOREIGN PATENT DOCUMENTS

| | | | |
|---|---|---|---|
| DE | 764265 | C | 11/1953 |
| DE | 19725320 | A1 | 12/1998 |

OTHER PUBLICATIONS

International Search Report and Written Opinion issued in connection with corresponding PCT Application No. PCT/US2012/046863 dated Feb. 18, 2014.

* cited by examiner

*Primary Examiner* — Zachary Kuhfuss
(74) *Attorney, Agent, or Firm* — GE Global Patent Operation; John A. Kramer

(57) ABSTRACT

Various methods and systems are provided for a crossing equipment controller. In one embodiment, a method comprises prior to a vehicle entering a diverging zone, calculating a travel time until the vehicle at a determined position would reach a crossing based on one or more vehicle conditions, and in response to the vehicle entering the diverging zone, updating the travel time with a time-based countdown.

12 Claims, 4 Drawing Sheets

SYSTEMS AND METHOD FOR A CROSSING EQUIPMENT CONTROLLER

CROSS REFERENCE TO RELATED APPLICATIONS

This application claims the benefit of U.S. Provisional Patent Application No. 61/508,212, filed Jul. 15, 2011, the disclosure of which is incorporated by reference in its entirety for all purposes.

FIELD

Embodiments of the subject matter disclosed herein relate to vehicle control systems. Other embodiments relate to methods for controlling vehicles with regard to rail crossings.

BACKGROUND

Currently, hardware and software exists for monitoring and controlling crossing signals and traffic routes. As vehicles approach crossings, crossing equipment can be activated to control the right of way. For example, as a train approaches a crossing with a highway, the crossing equipment is activated to stop vehicle traffic on the highway until after the train passes the crossing. Typically, the crossing equipment remains activated until the train passes the crossing or until it is confirmed that the train has stopped moving on the track. If it is detected that the train has stopped moving, a clearing timer is activated, and once the timer expires, the crossing equipment is deactivated.

However, it may be problematic to control a crossing when a track switch is present near the crossing, whereby a train is able to diverge from a first path to a second path. When the train diverges from the first path, the system may have a delay in determining whether the train has diverged to the second path or has stopped moving on the first path. Further, once the crossing signal equipment has determined that the train has exited the first path, a timer may be initiated, similar to situations wherein the train has stopped. When the timer expires, then the crossing equipment may be deactivated. The delay introduced by the divergence detection and the setting of the timer may result in an unsatisfactorily long crossing signal, causing user frustration with the system and inefficient right of way control.

BRIEF DESCRIPTION

In one embodiment, a method comprises, prior to a vehicle entering a diverging zone, calculating a travel time until the vehicle at a predetermined position would reach a crossing based on one or more vehicle conditions, and in response to the vehicle entering the diverging zone, updating the travel time with a time-based countdown.

In another embodiment, a method comprises, signaling to activate crossing equipment at a crossing zone in response to a vehicle reaching a threshold time-to-crossing, responding to the vehicle entering a diverging zone of a first path leading to the crossing zone by switching from a position-based time-to-crossing estimate to clock-countdown-based time-to-crossing estimate, and if the vehicle exits the first path ahead of the crossing zone, signaling to deactivate the crossing equipment upon expiration of the clock-countdown-based time-to-crossing estimate.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

The following description relates to various embodiments of controlling a crossing, such as a rail track and road crossing, that includes a diverging zone upstream of the crossing. (Upstream and downstream are relative to a direction of travel of a vehicle along a route; thus, if a vehicle is traveling in given direction along the route where the vehicle would first encounter a first feature and then encounter a second feature, the second feature is downstream of the first feature and the first feature is upstream of the second feature.) A diverging zone includes a switch to an alternate track, which with a vehicle traveling on the main track (e.g., the track including the crossing) may exit the main track and travel on the alternate track. (More generally, diverging zones may comprise a portion of a route that includes infrastructure for a vehicle to diverge from the route to a different route.) Such a diverging zone may confound speed- and position-based monitoring of the vehicle and result in delays in activating and/or deactivating the crossing equipment at the crossing if the vehicle diverges to the alternate track. By switching from speed- and position-based determination of a crossing time to a time-based estimation of a crossing time, according to embodiments of the invention, such delays may be avoided.

Figure 1:
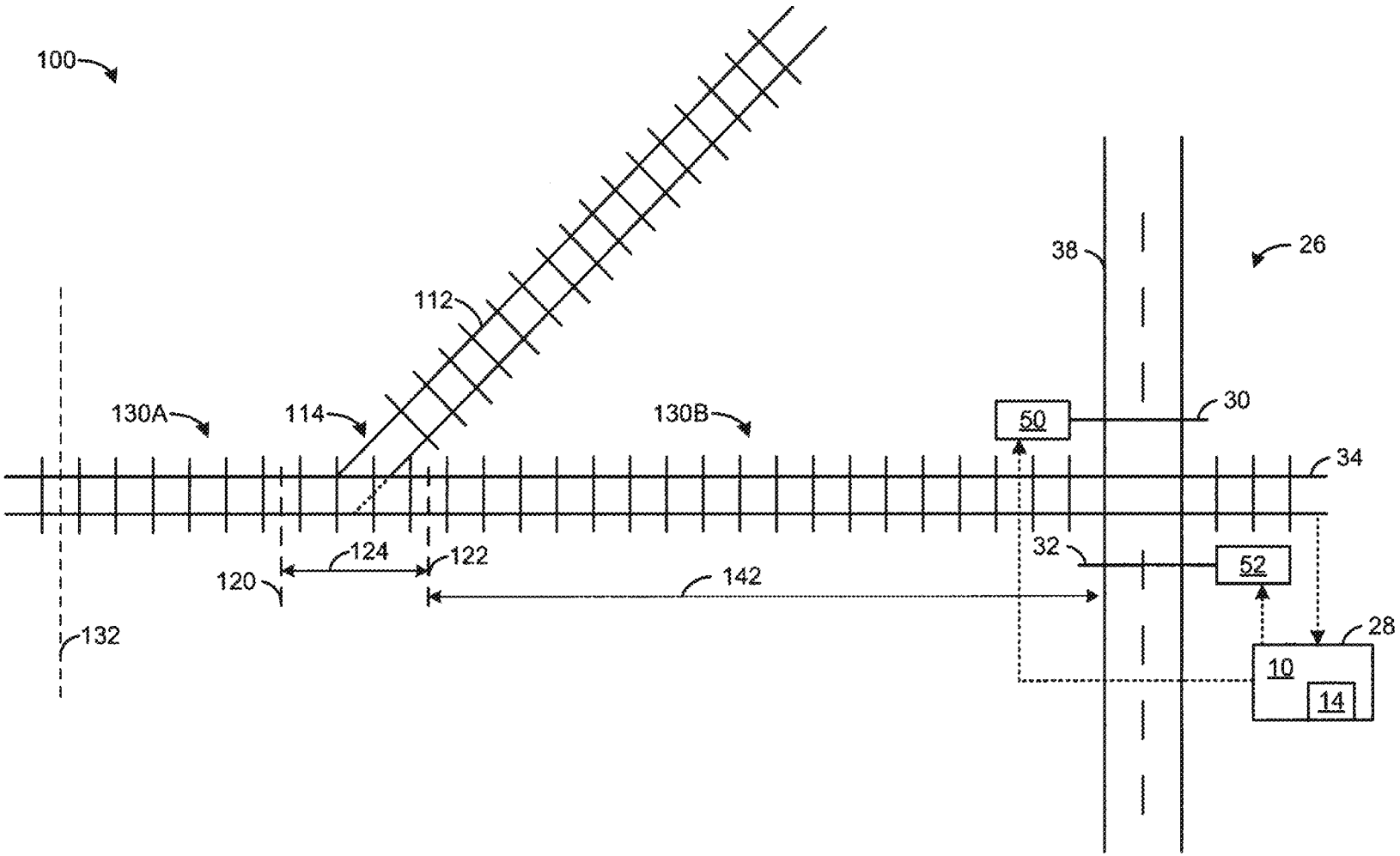
FIG. 1 shows simplified map of a railroad crossing including an upstream diverging zone.

FIG. 1 is a simplified block diagram of a crossing system 100 according to one embodiment of the disclosure. Crossing system 100 includes a crossing 26 where a road intersects a main rail track 34. The crossing system 100 also includes a bungalow or other housing 28 that houses a controller 10, and crossing equipment 50, 52 that lowers gate arms 30, 32 when activated due to the predicted presence of a vehicle, such as a train (not shown), on main track 34. A processor 14 is part of the controller 10 and may provide calculations as to whether to signal to activate or deactivate the crossing according to embodiments of the disclosure. The controller 10 further includes non-transitory computer readable storage media including code for enabling control of various components of the crossing system 100. The controller 10 is responsive to one or more signals to activate the crossing equipment and prevent entry into the crossing. For example, one or more shunts, transmitters, and/or receivers (not shown) may be present on both sides of the crossing 26 in order to provide signals to the controller 10 for determining a position and speed of a vehicle based on a change in impedance on the track. Transmission communications as used herein may be via a hardwired connection, via a radio link, or via field wiring, for example.

This activation causes the gate arms to drop, blocking oncoming traffic in both directions on a highway or other crossing roadway 38 that crosses the main track 34. Each gate arm may extend across a portion of the highway 38. This feature restricts entry to a prohibited area roughly defined as the area around and between railroad crossing equipment 50, 52.

Main track 34 has a diverging opportunity in the form of a rail switch-controlled side switch 114 that leads from the main route 34 (first route) to a siding or alternate track 112 (second route). In one state, the switch allows a vehicle traveling thereover to continue down the main track 34, and in a second state the switch diverts the path of the vehicle so as to leave the main track 34 in favor of the alternate track 112. A vehicle so diverted or diverged will not continue down the main track 34 and intersect with the crossing 26. Thus, a diverged vehicle results in a clear crossing until another vehicle travels through.

Relative to the side switch 114, there is a boundary that forms an upper bound 120 on one side of the switch 114 on the main track 34, and another boundary that forms the lower bound 122 on the another side of the switch 114. The upper and lower bounds define a diverging zone 124. The length of the diverging zone may be set based on one or more track parameters, such as distance from the crossing, expected average speed of vehicles traveling through the diverging zone, etc. The length of the diverging zone may be a predetermined, fixed length, or may be adjusted depending on conditions, such as presence of snow or ice on the track, load of the vehicle on the track, etc. On the main track 34, on either side of the diverging zone are areas of normal operation 130A, 130B. The diverging zone 124 is spaced from the crossing 26 by a portion 142 of the main track.

As a vehicle approaches the crossing 26, the controller uses signals to determine the speed and position of the vehicle. Based on the speed and position, a time-to-crossing may be determined. The time-to-crossing may be a countdown that reaches zero in proportion to the distance of the vehicle from the crossing, and may be adjusted as vehicle speed changes. Once the time-to-crossing reaches a threshold 132 (e.g., once the estimation of how long it will take the vehicle to reach the crossing falls below a time value of the threshold), the crossing equipment is activated.

Figure 2:
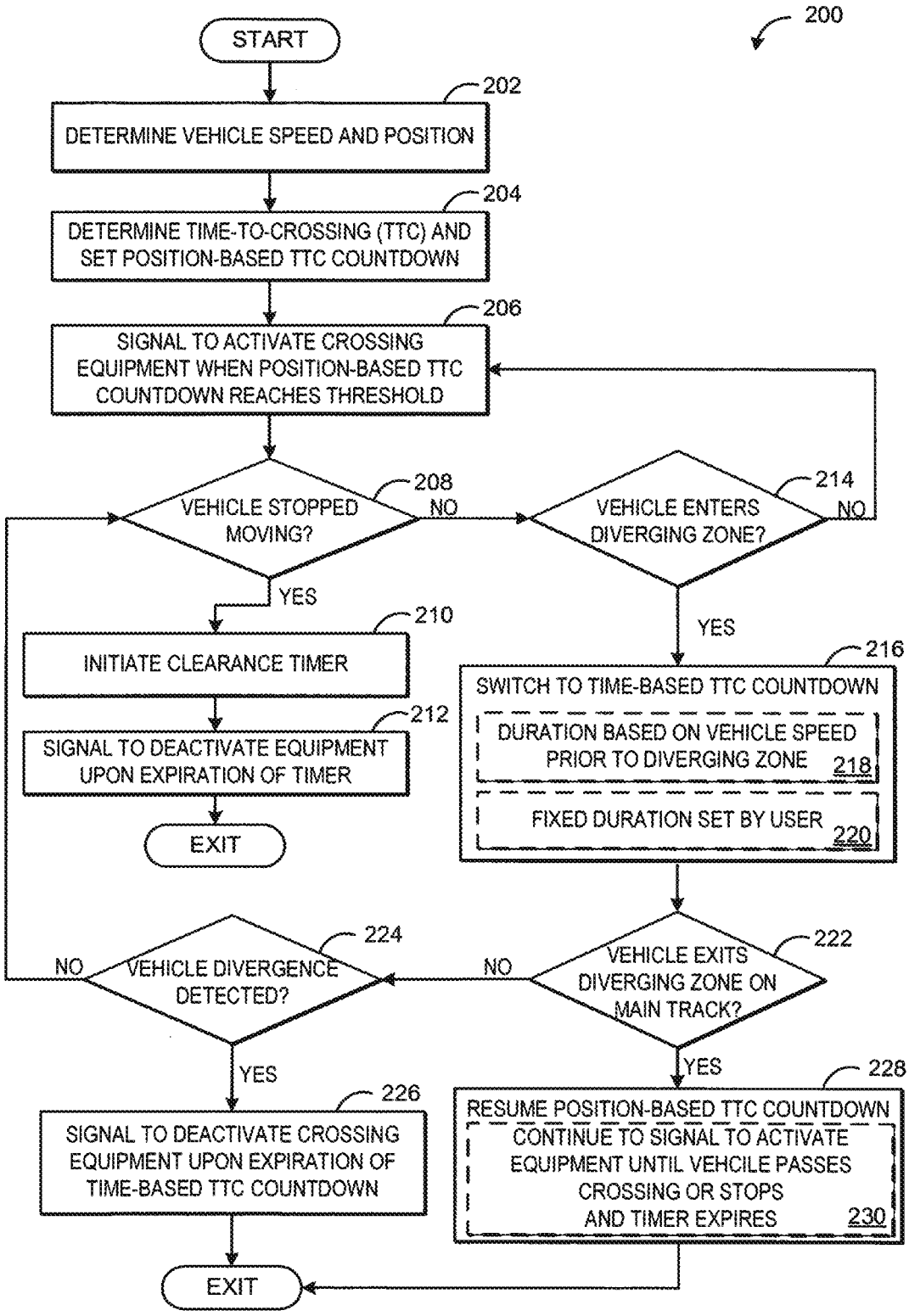
FIG. 2 is a flow chart illustrating a method for monitoring a crossing according to an embodiment of the present disclosure.

FIG. 2 is a flow chart illustrating a method 200 for monitoring a crossing of a path, such as rail and road crossing 26. Method 200 may monitor the speed and position of a vehicle, such as a train or other rail vehicle, traveling on a path, such as a track. The track or other path may include a diverging zone upstream of the crossing in a direction of travel of the vehicle. Method 200 may be carried out according to instructions stored in the memory of controller 10.

At 202, method 200 includes determining vehicle speed and/or position. The vehicle speed and position may be determined based on a change in the impedance of the track as the vehicle approaches the crossing. The impedance is determined by the controller based on signals from one or more transmitters and receivers coupled to the track. Further, a shunt may be located upstream of the crossing, and the controller may begin detecting vehicle speed and position upon the vehicle crossing the shunt. The axles of the vehicle may act as electrical shunts, essentially short-circuiting the track and causing the impedance on the track circuit to drop as the vehicle approaches the crossing.

At 204, a position-based time-to-crossing (TTC) estimate is determined. The position-based TTC estimate is an estimated duration of time until the vehicle reaches the crossing. The position-based TTC estimate may be used as a countdown, referred to herein as a position-based TTC countdown. The position-based TTC estimate is based on vehicle speed and/or position, and is continuously updated as the vehicle approaches the crossing, and/or as vehicle speed changes. For example, if the vehicle is traveling at a constant speed of 9 m/s and is 900 m away from a crossing, the position-based TTC estimate would be 100 seconds. As the vehicle approaches the crossing, the position-based TTC estimate decreases, for example when the vehicle is traveling at 9 m/s and is 450 m from the crossing, the position-based TTC estimate would be 50 seconds. Based on the determined position-based TTC estimate, the position-based TTC countdown is initiated. In one example, when the vehicle crosses the shunt, its speed and position may be tracked until the determined position-based TTC estimate reaches 100 seconds, at which point the position-based TTC countdown is initiated (e.g., with a duration of 100 seconds). The position-based TTC countdown is updated if vehicle speed changes.

At 206, method 200 includes signaling to activate crossing equipment when the position-based TTC countdown reaches a threshold TTC (threshold time-to-crossing). The threshold TTC may be preset in order to allow sufficient time for the crossing equipment to activate and give enough warning to other vehicles and/or pedestrians at the crossing. For example, the threshold TTC may be set so that the crossing equipment is activated when a vehicle is estimated to reach the crossing in 85 seconds. In some embodiments, the controller may itself activate the crossing equipment. However, in other embodiments, the controller may be configured to send a signal to the crossing equipment indicating the equipment is to be activated.

At 208, it is determined if the vehicle has stopped moving. As explained previously, vehicle movement may be detected based on track circuit impedance, which may decrease as the vehicle moves closer to the crossing. If the vehicle stops moving, the impedance may remain at a fixed amount, rather than continue to decrease. Thus, if the impedance determined by the controller stops changing (e.g., levels off) for a predetermined amount of time (e.g., five seconds), it may be determined that the vehicle has stopped moving. If the vehicle has stopped moving, at 210, a clearance timer is initiated. The clearance timer may be set equal to the position-based TTC estimate determined at a speed prior to the vehicle stop, or it may be a fixed amount, such as 20 seconds. At 212, upon expiration of the clearance timer, the crossing equipment is deactivated, and then method 200 exits.

If it is determined that the vehicle has not stopped moving, for example if the impedance determined by the controller continues to change, method 200 proceeds to 214 to determine if the vehicle has entered a diverging zone. As explained with respect to FIG. 1, the diverging zone includes a switch wherein a vehicle may diverge from a first path to a second path, such as the switch from the main track to the alternate track depicted in FIG. 1. If a vehicle diverges to the alternate track, it may be difficult for the controller to accurately monitor the vehicle's speed and position. For example, a train traveling on the track may include a plurality of rail vehicles. As the train starts to diverge to the alternate track, the first axle of the lead rail vehicle, which was initially used to track the vehicle's speed and location, moves to the alternate track, and then the vehicle's speed and position is determined by the next axle on the main track, and as that axle moves to the alternate track, the speed and position is determined by the following axle, and so on. As a result, the position and speed fluctuate around the switch, and the vehicle may appear to stop on the track.

The diverging zone may include upper and lower boundaries, which may be predetermined by a user of the crossing system. The upper and lower boundaries may be based on a distance from the switch to the alternate track. For example, each boundary may be located 50 feet from the switch. In another example, the upper and lower boundaries may be based on a time of travel from the switch, e.g., they may each be located 10 seconds from the switch as a function of an average speed or a designated maximum speed of a vehicle along that section of route/path. The controller determines if the vehicle has entered the diverging zone based on the position of the vehicle relative to the upper boundary, for example the controller may determine the vehicle has entered the diverging zone once the vehicle crosses the predetermined upper boundary.

If the vehicle has not entered a diverging zone, method 200 continues to track the vehicle speed and position and countdown to the crossing using the position-based TTC countdown and signals to activate the crossing equipment if the vehicle has reached the threshold TTC. However, if the vehicle enters the diverging zone, the controller may not be able to accurately detect its speed or position. To compensate, at 216, the controller switches to a time-based TTC countdown (e.g., clock-countdown-based time-to-crossing estimate) of a fixed duration that is not updated as vehicle speed and position change. That is, rather than predict a time to reach the crossing based on updated speed and position, as in the position-based TTC countdown, the time-based TTC countdown is set at fixed amount and subsequently counts down in time. The time-based TTC countdown is akin to a clock countdown, as the time-based TTC countdown does not change as vehicle speed and position change, and as such may also be referred to as a clock-countdown-based TTC estimate.

Switching to the time-based TTC countdown may include setting the duration of the time-based TTC countdown based on the speed of the vehicle prior to entering the diverging zone at 218. This assumes that the vehicle's speed is not expected to change significantly during the diverging zone. Using the speed of the vehicle and the position of the diverging zone relative to the crossing, the controller can calculate a time-to-crossing, and set the time-based TTC countdown to this amount when it is detected that the vehicle has entered the diverging zone. As the time-based TTC countdown is based on the vehicle speed prior to entering the diverging zone, it is approximately equal to the position-based TTC countdown at the diverging zone.

Switching to the time-based TTC countdown may include setting a fixed duration that is set by a user at 220. In conditions where the speed of the vehicle is expected to change significantly while in the diverging zone, the adjusted TTC countdown may set to a predetermined duration that is not dependent on the speed of the vehicle prior to reaching the diverging zone. This duration may be greater than or less than the calculated position-based TTC estimate at the diverging zone, in order to compensate for the expected change in vehicle speed.

At 222, it is determined if the vehicle has exited the diverging zone on the main track, that is, if it exits the diverging zone while remaining on the main track instead of diverging. Similar to entering the diverging zone, it may be determined that the vehicle has exited the zone if its determined position crosses the lower boundary of the diverging zone, and the controller is able to track the position of the vehicle downstream of the diverging zone. If not, method 200 proceeds to 224 to determine if the vehicle has diverged from the main track to the alternate track. In one embodiment, this may be determined based on a loss of position and speed signal as the vehicle is no longer on the main track. For example, the percent distance to the crossing determined by the controller may return to 100 once the vehicle exits the main track in favor of the alternate track. Further, in some embodiments, the divergence may be detected based on position signal fluctuation. In one example, divergence may be detected based on a combination of initial position signal variation within the divergence zone followed by total loss of signal once the vehicle diverges, and/or may be based on expiration of the time-based TTC countdown. If the controller is still receiving signals related to the speed and position of the train on the main track, divergence is not detected and method 200 proceeds back to 208 to determine if the vehicle has stopped. If the vehicle has diverged, method 200 proceeds to 226 to signal to deactivate the crossing equipment upon expiration of the time-based TTC countdown. Method 200 then exits.

Returning to 222, if is determined that the vehicle has exited the diverging zone on the main track, method 200 proceeds to 228 to resume the position-based TTC countdown. Resuming the position-based TTC countdown may include, at 230, continuing to signal to activate the crossing equipment until the vehicle passes the crossing or until the vehicle reaches a complete stop before reaching the crossing, and, if the vehicle stops, continuing to signal to activate the equipment until the clearance timer expires. The crossing equipment may remain activated if the vehicle exits the diverging zone within a threshold time-to-crossing from the crossing. For example, as explained above, if the threshold time-to-crossing is 85 seconds and the vehicle exits the diverging zone at a time-to-crossing of 45 seconds, the crossing equipment will remain activated. Upon resuming the position-based TTC countdown, method 200 exits.

Thus, method 200 of FIG. 2 provides for switching from a speed and position based time-to-crossing estimate (e.g., the position-based TTC countdown) to a time-based countdown (e.g., clock-countdown-based time-to-crossing estimate,) in response to a vehicle entering a diverging zone. The time-based countdown is set upon the vehicle entering the diverging zone, and does not change regardless of changing vehicle speed. If the vehicle diverges, the time-based TTC countdown will continue to run, and upon its expiration, the crossing equipment will be deactivated. As the time-based TTC countdown may be based on vehicle speed prior to reaching the diverging zone, the time-based TTC countdown may be approximately equal to the time it would take the vehicle to reach the crossing were it to remain on the track. In this way, the crossing equipment may be activated for the same amount of time regardless of whether the vehicle diverges or stays on the track. By doing so, unnecessarily long crossing times may be avoided.

In another embodiment, a method comprises signaling to activate crossing equipment at a crossing based on a first estimate of how long it will take a vehicle to reach the crossing along a first path that intersects the crossing. The first estimate is based on at least one of a position or a speed of the vehicle. When the vehicle enters a diverging zone, the method further comprises switching from the first estimate to a second estimate of how long it will take the vehicle to reach the crossing. The diverging zone is an area of the first path ahead of the crossing that includes infrastructure for the vehicle to diverge from the first path to a different, second path. The second estimate is time-based, e.g., the second estimate may be a clock countdown. If the vehicle diverges to the second path, the method further comprises signaling to deactivate the crossing equipment upon expiration of the second estimate (clock countdown).

The method 200 of FIG. 2 provides for operation in multiple modes. In one mode of operation ("Auto Mode"), if the crossing equipment at a crossing is activated by an approach of a train on a main set of tracks (or other vehicle along a main section of route), the controller may set a time-to-clear period (e.g., the adjusted TTC countdown) that is equal to the predicted time-to-crossing in response to the approaching train entering the diverging zone. Further the controller will begin counting down time until the time-to-clear period has expired. If the time-to-clear period expires, the crossing will be indicated as being clear and the crossing equipment will be deactivated, unless any variables other than the time-to-crossing variables indicate that the crossing is not clear. If the train exits the diverging zone without diverging, the controller and crossing equipment will resume standard operation, that is, will resume the speed and position-based estimated TTC countdown.

In another mode of operation ("Manual Mode"), the time-to-clear is manually calculated based on one or more external parameters. A suitable external parameter may be a speed of the train, a length of the train, a train type, condition or status of switches, and the like. Other suitable external parameters may include a distance to crossing from an upper bound of the diverging zone, distance to crossing from a lower bound of the diverging zone, distance to crossing from a switch, distance to crossing for the vehicle at a given time, and percent of approach to crossing (e.g., vehicle distance versus switch distance). If train speed is used, then the train speed may be signaled from onboard speed measurement systems, signaled from off-board speed measurement systems, may be calculated from indirect factors, or be obtained by estimation or from a lookup table. In this operating mode, when a train enters the diverging zone, the controller uses a time-to-clear that counts down from a user defined value. Once the time-to-clear period expires, the controller may set the crossing as clear and/or deactivate the crossing equipment. Similarly to Auto Mode, if the train exits the diverging zone before time-to-clear expires, the controller and crossing equipment may resume standard operation.

In an instance where the train does not diverge, the distance between the diverging zone's upper and lower bounds is defined to be smaller than the total distance between the upper bound and the crossing. Since the diverging zone will be smaller than the distance to crossing, the time it takes to exit the diverging zone will be less than the time it takes to actually clear a train through the crossing. This is useful when used in a situation where linear speed can be assumed. If the train does not diverge and drives past the diverging zone, the prediction circuit of the controller may reset the time-to-clear and resume standard operation.

If the train slows down in the diverging zone while in Auto Mode, the distance in the diverging zone may be much smaller than the distance from the upper bound to the crossing. In one example, it may be up to 50 percent shorter distance. When a diverging move does not occur so that the train stays on the main track, the train may drastically reduce speed but still exit the zone prior to the time-to-clear expiring. However, where the train has slowed down so much (or stopped) that it will not exit the diverging zone before the time-to-clear has expired, there may be a false clearing of the signal at the crossing. Accordingly, the controller may use Auto Mode only where it is appropriate to assume linear speed of the train. Linear speed may be assumed in many diverging move applications. Manual Mode may be implemented by the controller in areas or instances where linear speed cannot be assumed.

Figure 3:
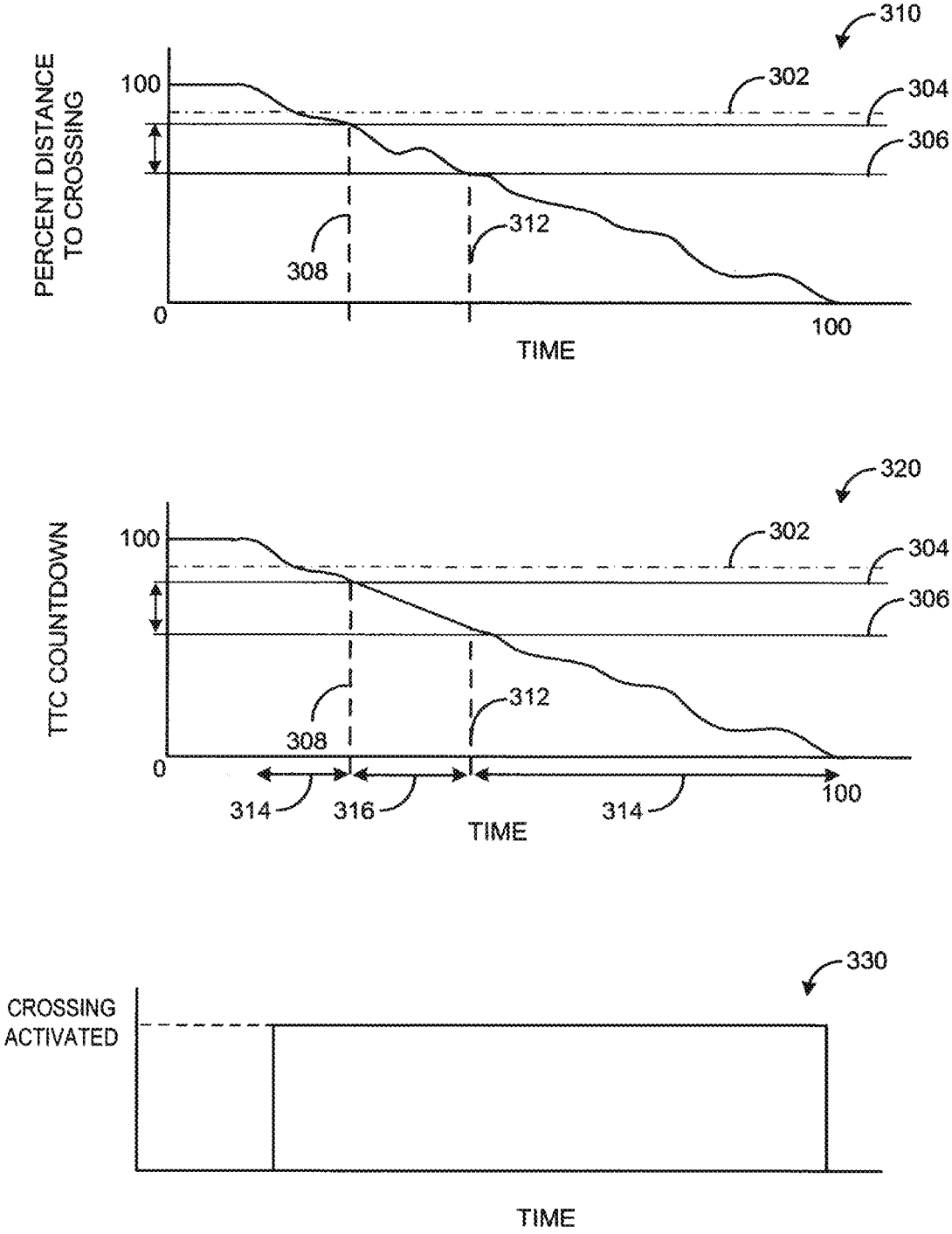
FIG. 3 is example position, countdown, and crossing equipment activation maps for a vehicle approaching a crossing without diverging according to an embodiment of the present disclosure.

FIG. 3 illustrates example position, countdown, and crossing equipment maps as a vehicle approaches a crossing without diverging from the main track. Map 310 depicts percent distance of a vehicle position to a crossing as a function of time. The distance from the crossing may be determined based on the speed and position signals received at the controller. A threshold TTC is depicted at 302. Upon reaching this position, the crossing equipment will be activated. A diverging zone is also present, including an upper boundary 304 and a lower boundary 306. As shown in 310, the vehicle travels through the diverging zone without diverging, as the position signal tracks the vehicle entering the zone at time 308 and exiting the zone at time 312, and continues to track the vehicle's position until it reaches the crossing.

Map 320 depicts the TTC countdown as a function of time. Prior to reaching the diverging zone, the determination as when the vehicle will reach the crossing is based on the position-based TTC countdown, depicted by arrow 314. Because the position-based countdown is calculated based on determined vehicle speed and position, it fluctuates in proportion to the change in vehicle position (as shown in 310). However, at 308, when the vehicle enters the diverging zone, the TTC countdown is switched to the time-based TTC countdown, depicted by arrow 316. The time-based TTC countdown does not fluctuate as vehicle speed changes, but is instead a fixed, linear countdown. At 312, when the vehicle exits the diverging zone, the position-based TTC countdown 314 is resumed.

Map 330 illustrates the activation of the crossing equipment. The crossing equipment is activated when the vehicle reaches the threshold TTC, and remains activated until the vehicle passes the crossing, as determined by the position-based TTC countdown.

Figure 4:
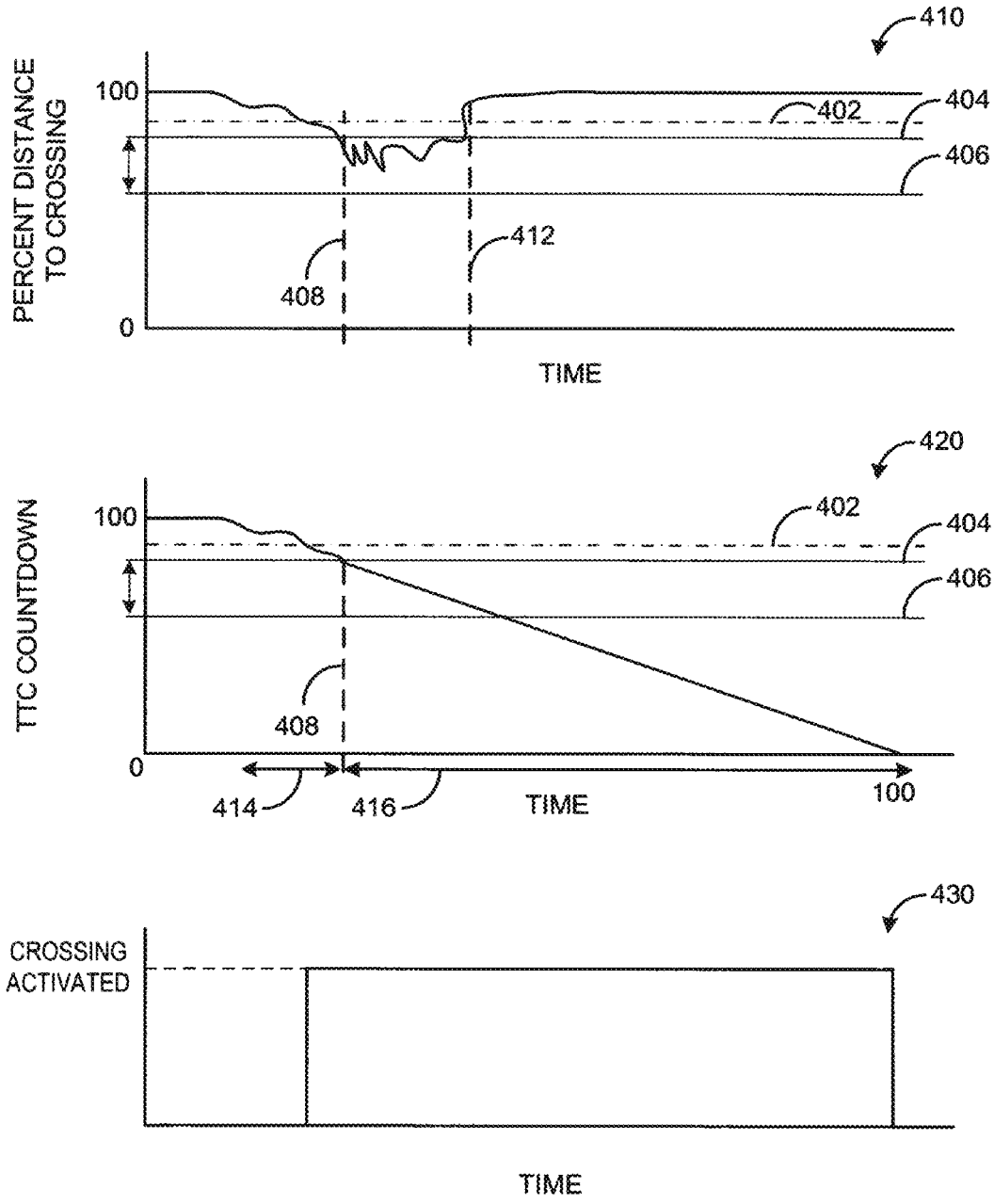
FIG. 4 is example position, countdown, and crossing equipment activation maps for a vehicle approaching a crossing and diverging according to an embodiment of the present disclosure.

FIG. 4 illustrates example position, countdown, and crossing equipment maps as a vehicle approaches a crossing and then diverges from the main track. Map 410 depicts percent distance of a vehicle position to a crossing as a function of time. The distance from the crossing may be determined based on the speed and position signals received at the controller. A threshold TTC is depicted at 402. Upon reaching this position, the crossing equipment will be activated. A diverging zone is also present, including an upper boundary 404 and a lower boundary 406. As shown in map 410, the vehicle enters the diverging zone at time 408. As the vehicle beings to diverge from the main track, the speed and position signals fluctuate, as explained previously. Thus, the distance to crossing fluctuates, until the vehicle fully diverges, at which point the percent distance to crossing returns to 100 at time 412.

Map 420 depicts the TTC countdown as a function of time. Prior to reaching the diverging zone, the TTC countdown is the position-based TTC countdown 414, and as such fluctuates in proportion to the change in vehicle position (as shown in 410). However, at 408, when the vehicle enters the diverging zone, the TTC countdown is switched to the time-based TTC countdown depicted by arrow 416. The time-based TTC countdown does not fluctuate as vehicle speed changes, but is instead a fixed, linear countdown. As the vehicle has diverged from the main track, the time-based TTC countdown continues until it expires.

Map 430 illustrates the activation of the crossing equipment. The crossing equipment is activated when the vehicle reaches the threshold TTC, and remains activated until the expiration of the time-based TTC countdown.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

crossing equipment associated with a track, the track including a diverging zone that comprises a portion of the track and a switch to an alternate track, wherein the crossing equipment is located at a crossing of the track downstream from the diverging zone; and a controller communicatively coupled with the crossing equipment and including instructions to:

activate the crossing equipment in response to a vehicle reaching a threshold time-to-crossing;

in response to the vehicle entering the diverging zone, switch from a position-based time-to-crossing countdown to time-based time-to-crossing countdown, where the time-based time-to-crossing countdown is a fixed duration based on vehicle speed and position prior to reaching the diverging zone;

if the vehicle switches to the alternate track, deactivate the crossing equipment upon expiration of the time-based time-to-crossing countdown; and if the vehicle remains on the track, resume the position-based time-to-crossing countdown.

2. The system of claim 1, wherein the position-based time-to-crossing countdown is based on vehicle speed and position, and wherein the controller includes instructions to change the position-based time-to-crossing countdown as vehicle speed changes.

3. The system of claim 1, wherein the time-based time-to-crossing countdown is a fixed duration that is not updated as vehicle speed and position change in the diverging zone.

4. The system of claim 1, wherein the controller includes further instructions to, if the vehicle remains on the track, continue to activate the crossing equipment until the vehicle passes the crossing or stops moving.

5. The system of claim 1, wherein a duration of the time-based time-to-crossing countdown is manually set by a user.

6. The system of claim 1, wherein the threshold time-to-crossing comprises a preset time until the vehicle reaches the crossing.

7. The system of claim 1, wherein a length of the diverging zone is adjusted based on one or more of vehicle speed, track conditions, and vehicle length, the track conditions including a presence of snow or ice on the track.

8. A system comprising, crossing equipment associated with a track, the track including a diverging zone that comprises a portion of the track and a switch to an alternate track, wherein the crossing equipment is located at a crossing of the track downstream from the diverging zone; and a controller communicatively coupled with the crossing equipment and including instructions to:

activate the crossing equipment in response to a vehicle reaching a threshold time-to-crossing;

in response to the vehicle entering the diverging zone, switch from a position-based time-to-crossing countdown to time-based time-to-crossing countdown, where a duration of the time-based time-to-crossing countdown is equal to a duration of the position-based time-to-crossing countdown at the diverging zone if the vehicle switches to the alternate track, deactivate the crossing equipment upon expiration of the time-based time-to-crossing countdown; and if the vehicle remains on the track, resume the position-based time-to-crossing countdown.

9. A system, comprising:

a controller that is communicatively coupleable to crossing equipment at a crossing, and the controller has an operating mode where the controller is configured to:

calculate a Time-To-Clear period based on one or more external parameters;

initiate a countdown of the Time-To-Clear period in response to a vehicle entering a diverging zone, the diverging zone defined between an upper bound upstream of a switch to an alternate track and a lower bound downstream of the switch to the alternate track, where a length of the diverging zone is adjustable based on operating conditions; and respond to expiry of the Time-To-Clear period by deactivating the crossing equipment.

10. The system of claim 9, wherein the one or more external parameters comprise one or more of a speed of the vehicle, a length of a train propelled by the vehicle, a vehicle type, a condition of a railroad switch, a status of the railroad switch, a distance to the crossing from the upper bound of the diverging zone, a distance to crossing from the lower bound of the diverging zone, distance to crossing from the railroad switch, a distance to crossing for the vehicle at a given time, or a percent of approach to crossing traveled by the vehicle versus a distance of the railroad switch to the crossing and wherein the operating conditions comprise one or more of a distance from the switch to the alternate track, a time to travel from the switch to the alternate track, a load of the vehicle on a track on which the vehicle is traveling, or a presence of ice or snow pack on the track.

11. The system of claim 9, wherein the controller is further configured to set the Time-To-Clear period to be equal to a predicted Time-To-Crossing of the vehicle from the diverging zone to the crossing.

12. The system of claim 9, wherein the controller is further configured to resume a standard operating mode if the vehicle exits the diverging zone without diverging from a main track that intersects with the crossing.

* * * * *